US006575847B1

(12) United States Patent
Yamagishi et al.

(10) Patent No.: US 6,575,847 B1
(45) **Date of Patent: *Jun. 10, 2003**

(54) GOLF BALL AND METHOD OF MANUFACTURING THE SAME

(75) Inventors: Hisashi Yamagishi, Saitama (JP); Takashi Maruko, Saiatama (JP); Yutaka Masutani, Saitama (JP); Michio Inoue, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 119 days.

This patent is subject to a terminal disclaimer.

(21) Appl. No.: 09/668,146

(22) Filed: Sep. 25, 2000

(30) Foreign Application Priority Data

Oct. 15, 1999 (JP) ..... 11-294132

(51) Int. Cl.[7] ..... A63B 37/04; A63B 37/06; A63B 37/00; G09F 3/00

(52) U.S. Cl. ..... 473/374; 473/351; 40/327

(58) Field of Search ..... 473/351, 367, 473/368, 370, 371, 374, 376, 377, 378; 40/327

(56) References Cited

U.S. PATENT DOCUMENTS

| | | | | | |
|---|---|---|---|---|---|
| 698,516 | A | * | 4/1902 | Kempshall | 473/370 |
| 1,482,232 | A | * | 1/1924 | Hazeltine | 40/327 |
| 2,839,853 | A | * | 6/1958 | Giangreco | 40/327 |
| 3,318,598 | A | * | 5/1967 | Ruskin | 40/327 |
| 3,364,607 | A | * | 1/1968 | Twicker | 40/327 |
| 4,235,441 | A | * | 11/1980 | Ciccarello | 40/327 |
| 5,320,345 | A | * | 6/1994 | Lai et al. | 40/327 |
| 5,651,741 | A | * | 7/1997 | Masutani et al. | 40/327 |
| 5,785,612 | A | * | 7/1998 | Shapiro et al. | 40/327 |
| 5,823,891 | A | * | 10/1998 | Winskowicz | 473/378 |
| 5,984,806 | A | * | 11/1999 | Sullivan et al. | 40/327 |
| 6,012,992 | A | * | 1/2000 | Yavitz | 40/327 |

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A golf ball includes at least a core, an inner cover, and an outer cover. The inner and outer covers are of different colors. A portion of the inner cover penetrates the outer cover and is exposed to the outside on the surface of the golf ball. The exposed portion constitutes a mark portion on the surface of the golf ball. Further, an auxiliary layer is provided in contact with the inner cover. The auxiliary layer has a color different from those of the inner and outer covers and has an end surface which is exposed to the outside on the surface of the golf ball within the mark portion. Either the inner cover or the auxiliary layer completely covers the core.

5 Claims, 5 Drawing Sheets

GOLF BALL AND METHOD OF MANUFACTURING THE SAME

BACKGROUND OF THE INVENTION

1. Field of the Invention

The present invention relates to a golf ball comprising a core, an inner cover, and an outer cover, and more particularly to a golf ball having a mark portion for indicating, for example, a trademark, a number, a symbol, a figure, or a pattern, which is formed on the surface of the outer cover when the cover is molded.

2. Description of the Related Art

Most solid golf balls have had a two-layer (a two-piece) structure in which a single layer core is covered with a single-layer cover. In recent years, however, there have been proposed and marketed many kinds of multi-layer golf balls having three or more layers in which at least one of a core and a cover comprises two or more layers. A process of manufacturing such a multi-layer golf ball having three or more layers involves many manufacturing steps. For example, a three-layer golf ball comprising a core, an inner cover and an outer cover is manufactured through the steps of: (1) molding a core, (2) conveying the core to an inner cover injection stage, (3) placing the core into a hopper (a storage apparatus) for temporary storage, (4) injection molding an inner cover on the core, (5) conveying the core covered with the inner cover to an outer cover injection stage, (6) placing the core into a hopper (a storage apparatus) for temporary storage, and (7) injection molding an outer cover on the core covered with the inner cover.

A mark portion indicating, for example, a number or a trademark including characters or a figure is provided on the surface of a golf ball. The mark portion is generally formed by means of a decalcomania method in which, after a core has been covered with a cover, a decalcomania film printed on decalcomania paper is transferred, through heating and pressing, onto the mark-forming site of the surface of the cover.

The above-described process for manufacturing multi-layer golf balls having three or more layers is more complicated than a process for manufacturing conventional two-piece golf balls. Therefore, manufacturing cost increases.

Also, the process of forming a mark portion by means of the conventional decalcomania method requires an independent process of forming the mark portion after molding of a cover. Therefore, the process for manufacturing golf balls become complicated and thus involve disadvantages in terms of productivity and manufacturing cost. Japanese Patent No. 2904737 discloses a cover material for a golf ball which has eliminated the above-mentioned disadvantages. The cover material is formed by means of a multi-color injection molding process employing two or more kinds of molding materials of different colors, and has the shape of a hemispherical cup. A mark portion is formed on the outermost surface of the cover material by at least one of the molding materials. The cover material is used for compression molding of a cover.

However, in the above-mentioned cover material of Japanese Patent No. 2904737, the molding material forming the mark portion does not completely enclose a core. Thus, a golf ball manufactured from the cover material has a problem in which stress is apt to concentrate upon impact at the boundary between a molding material which forms the mark portion and another molding material which is in contact therewith. Therefore, the cover material leaves room for improvement in terms of durability of the mark portion and the ball itself.

SUMMARY OF THE INVENTION

The present invention has been accomplished in view of the above-mentioned circumstances, and an object of the present invention is to provide a multi-layer golf ball which comprises at least a core, an inner cover, and an outer cover; which can be produced in a simple manufacturing process; a mark portion of which can be formed without an independent formation process, so as to reduce manufacturing cost; and which is excellent in durability of the mark portion and the ball itself.

In order to achieve the above object, the present invention provides a golf ball which comprises at least a core, an inner cover, and an outer cover. The inner and outer covers are of different colors, and a portion of the inner cover penetrates the outer cover and is exposed to the outside on the surface of the golf ball. The exposed portion constitutes a mark portion on the surface of the golf ball. Further, an auxiliary layer is provided in contact with the inner cover. The auxiliary layer has a color different from those of the inner and outer covers and has an end surface which is exposed to the outside on the surface of the golf ball within the mark portion. Either the inner cover or the auxiliary layer completely covers the core.

In the golf ball of the present invention, the inner cover, the outer cover, and the auxiliary layer are molded in a single stage through use of an injection molding machine (described later) in which an inner-cover mold, an outer-cover mold, and an auxiliary-layer mold are arranged on a common mold base. Also, the mark portion can be formed when the inner cover, the outer cover, and the auxiliary layer are formed, and therefore no independent process of forming the mark portion is necessary. That is, the golf ball of the present invention can be manufactured in a simple process comprising the steps of: (1) molding a core, (2) conveying the core to a stage for injection molding of the inner and outer covers and the auxiliary layer, (3) placing the core into a hopper for temporary storage, and (4) forming the inner and outer covers, the auxiliary layer, and the mark portion by injection molding, whereby manufacturing cost is reduced.

In the golf ball of the present invention, the inner cover or the auxiliary layer completely encloses the core and the mark portion is formed by a portion of the inner cover and a portion of the auxiliary layer. This structure prevents stress from concentrating upon impact at the boundary between the inner and outer covers, and excellent durability of the mark portion and the ball itself can be achieved. Further, because the mark portion is formed by a portion of the inner cover, the golf ball of the present invention has also an advantage of improved appearance, as compared with a ball whose mark is formed by means of the decalcomania method. In addition, since the end surface of the auxiliary layer appears within the mark portion on the surface of the golf ball, the mark portion is of excellent design.

BRIEF DESCRIPTION OF THE DRAWING

FIGS. 2A and 2B show a golf ball according to an embodiment of the present invention, wherein FIG. 2A is a schematic partial sectional view of the golf ball, and FIG. 2B is a plan view of a portion surrounded by a broken line in FIG. 2A;

DESCRIPTION OF THE INVENTION AND PREFERRED EMBODIMENT

Figure 1A:
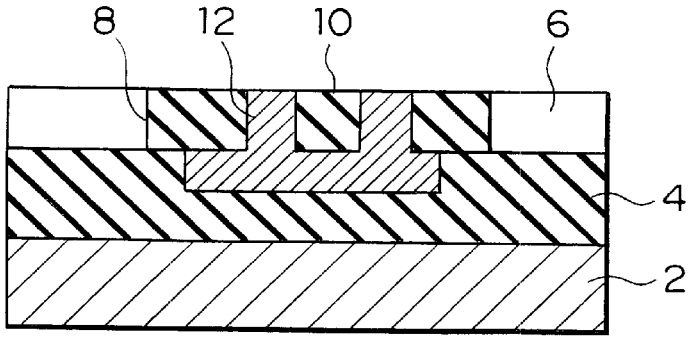
FIGS. 1A to 1C each show a schematic sectional view of a golf ball according to the present invention.
Figure 1B:
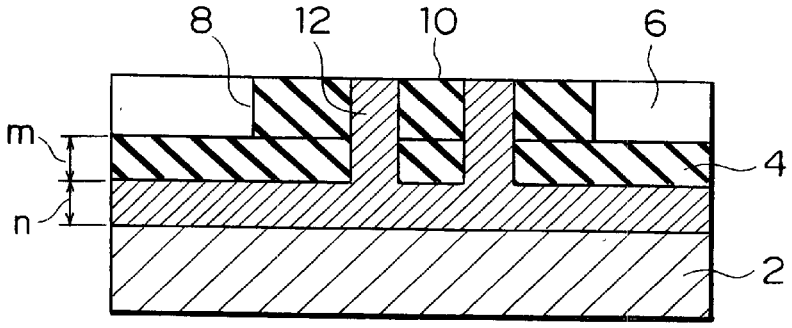
Figure 1C:
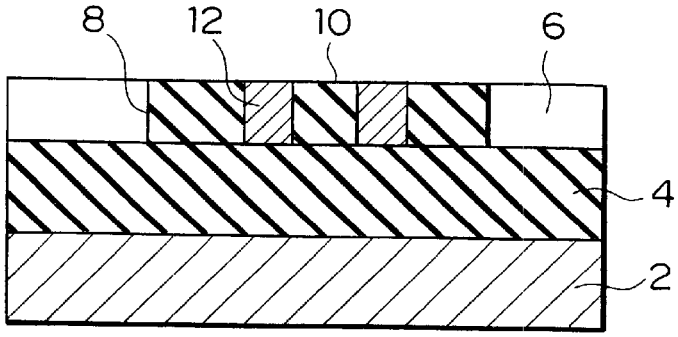

The present invention will now be described in more detail with reference to the accompanying drawings. FIGS 1A to 1C each show a schematic sectional view of a golf ball according to the present invention. Each of these golf balls comprises at least a core 2, an inner cover 4, and an outer cover 6. The inner cover 4 and the outer cover 6 are of different colors. A portion 8 of the inner cover 4 penetrates the outer cover 6 and is exposed to the outside on the surface of the golf ball. The exposed portion constitutes a mark portion 10 on the surface of the golf ball. Further, an auxiliary layer 12 is provided in contact with the inner cover 4. The auxiliary layer 12 has a color different those of the inner cover 4 and the outer cover 6 and has an end surface which is exposed to the outside on the surface of the golf ball within the mark portion. In the golf balls shown in FIGS. 1A and 1C, the inner cover 4 completely covers the core 2, and in the golf ball shown in FIG. 1B, the auxiliary layer 12 completely covers the core 2. The mark portion 10—which are formed by the portion 8 of the inner cover 4 and the end surface of the auxiliary layer 12—displays in any color a trademark, a number, a symbol, a figure, or a pattern; however, what is displayed is not limited to the above. The manner in which the auxiliary layer 12 is formed is not limited to the above-described examples, and the auxiliary layer 12 may be formed in any of various manners.

In the golf ball of the present invention, if an excessive difference in hardness exists between the inner cover 4 and the outer cover 6, upon repeated impact the boundary portion between the outer cover and the portion of the inner cover which penetrates the outer cover is deformed repeatedly, with the result that stresses tend to concentrate at the boundary portion. Therefore, there is a possibility of the mark portion or the ball itself being destroyed earlier than intended. Therefore, the difference in hardness between the inner and outer covers is set to not greater than 15, preferably not greater than 13, and more preferably not greater than 10 in Shore D hardness. Either of the inner and the outer cover may be harder than the other. For the same reason, the difference in hardness between the auxiliary layer and the inner cover and the difference in hardness between the auxiliary layer and the outer cover are each set to not greater than 15, preferably not greater than 13, and more preferably not greater than 10 in Shore D hardness.

Each layer which constitutes the golf ball of the present invention will be described. In the golf ball of the present invention, either a solid core or a thread wound core may be used. A solid core is produced by molding a rubber material into a spherical shape. A thread wound core is produced through winding rubber threads on a liquid center or a solid center into a spherical shape. The solid core is formed of a rubber material which contains, as a main component, 1,4-cispolybutadiene, polyisoprene, natural rubber, or silicone rubber. The rubber material may contain proper amounts of optional components such as crosslinking agents, antioxidants, and fillers. The structure of the solid core may be of a single layer or multiple layers.

No limitation is imposed on the materials of the inner and outer covers and the auxiliary layer, and known cover materials can be used for preparation of the inner and outer covers and the auxiliary layer. For example, any one of an ionomer resin, a polyurethane resin, and a polyester resin can be selectively used. Preferably, ionomer resin, more specifically, Surlyn (Du Pont) or Himilan (Mitsui-Du Pont Polychemical), can be used. When any of these materials is used, coloring materials of different colors are added to the inner cover material, the outer cover material, and the auxiliary layer material, respectively. If desired, other optional components may be added to the inner cover material, the outer cover material, and the auxiliary layer material.

Figure 2A:
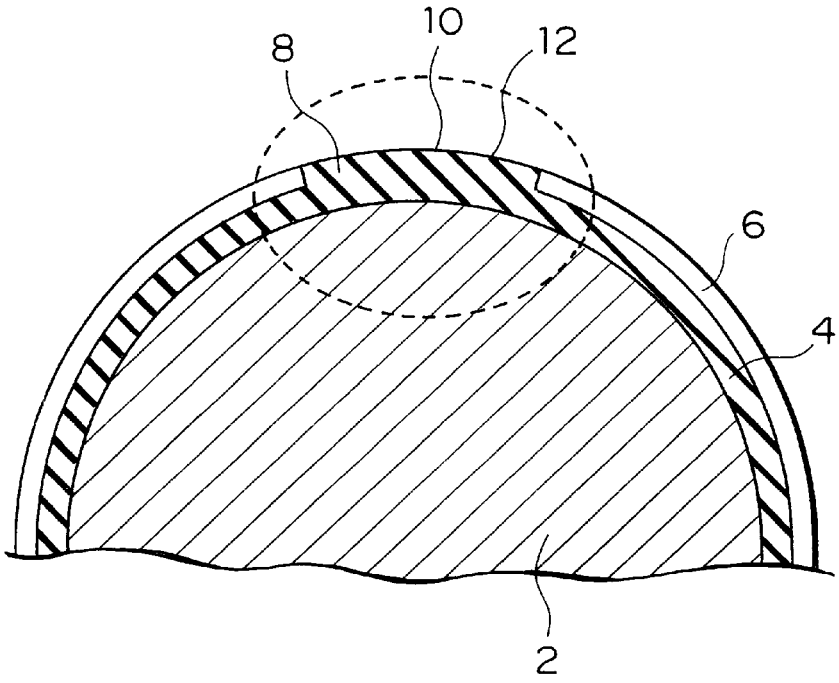
Figure 2B:
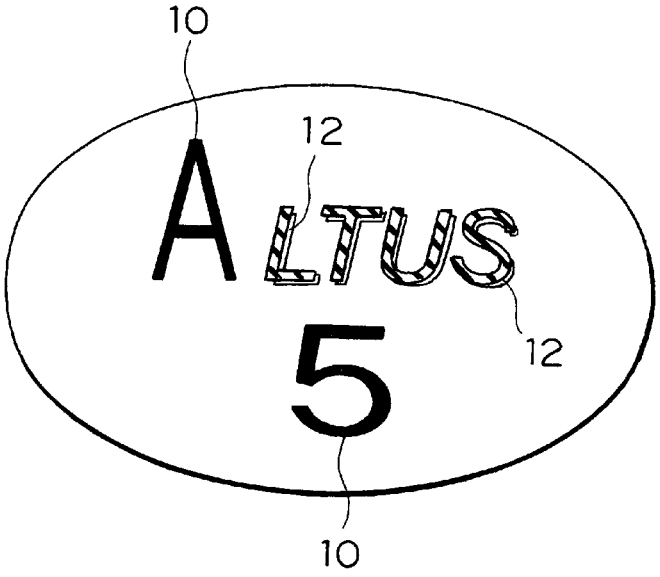

Next, an embodiment of the present invention will be described. FIGS. 2A and 2B show a golf ball according to the embodiment of the present invention, wherein FIG. 2A is a schematic partial sectional view of the golf ball, and FIG. 2B is a plan view of a portion surrounded by a broken line in FIG. 2A. The golf ball of the present embodiment comprises a core 2, an inner cover 4, and an outer cover 6. The inner cover 4 completely encloses the core 2, the inner cover 4 and the outer cover 6 are of different colors, and portions 8 (hereinafter may be referred to as "protrusions") of the inner cover 4 penetrate the outer cover 6 and are exposed to the outside on the surface of the golf ball. The exposed end surfaces of the protrusions 8 constitute a mark portion 10 for indicating a trademark "ALTUS" and a number "5" on the surface of the ball. Further, an auxiliary layer 12 is provided in contact with the inner cover 4. The auxiliary layer 12 has a color different from those of the inner cover 4 and the outer cover 6 and has an end surface which is exposed to the outside on the surface of the golf ball within the mark portion 10. In the present embodiment, the auxiliary layer 12 is formed in the manner shown in FIG. 1A. The inner cover 4 is colored, for example, blue, oxford blue, or black; the outer cover 6 is colored, for example, white; and the auxiliary layer 12 is colored, for example, red. The difference in hardness between the inner cover 4 and the outer cover 6 is set to 15 or less in Shore D hardness.

Figure 3:
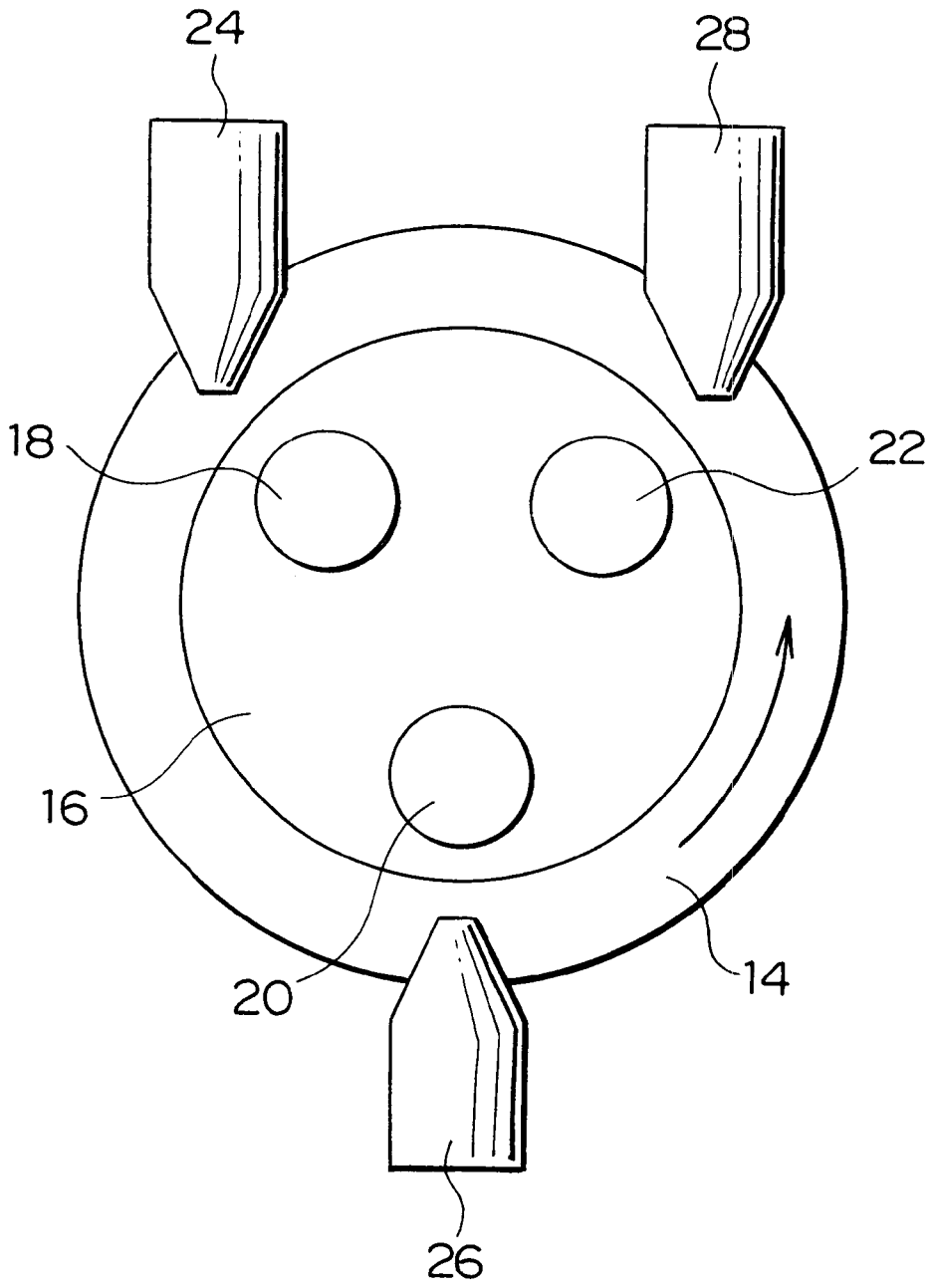
FIG. 3 is a schematic view showing an example molding machine for molding the inner and outer covers and auxiliary layer of the golf ball according to the present invention.

The golf ball of the present embodiment can be manufactured through use of a molding machine shown in FIG. 3. In FIG. 3, reference numeral 14 denotes a base, and reference numeral 16 denotes a rotary-table-type mold base which is mounted on the base 14 to be rotatable in the direction of an arrow in FIG. 3. An inner-cover mold 18, an auxiliary-layer mold 20, and an outer-cover mold 22 are arranged on the mold base 16. Reference numeral 24 denotes an inner-cover injection cylinder for injecting resin into the inner-cover mold 18, reference numeral 26 denotes an auxiliary-layer injection cylinder for injecting resin into the auxiliary-layer mold 20, and reference numeral 28 denotes an outer-cover injection cylinder for injecting resin into the outer-cover mold 22.

Figure 4:
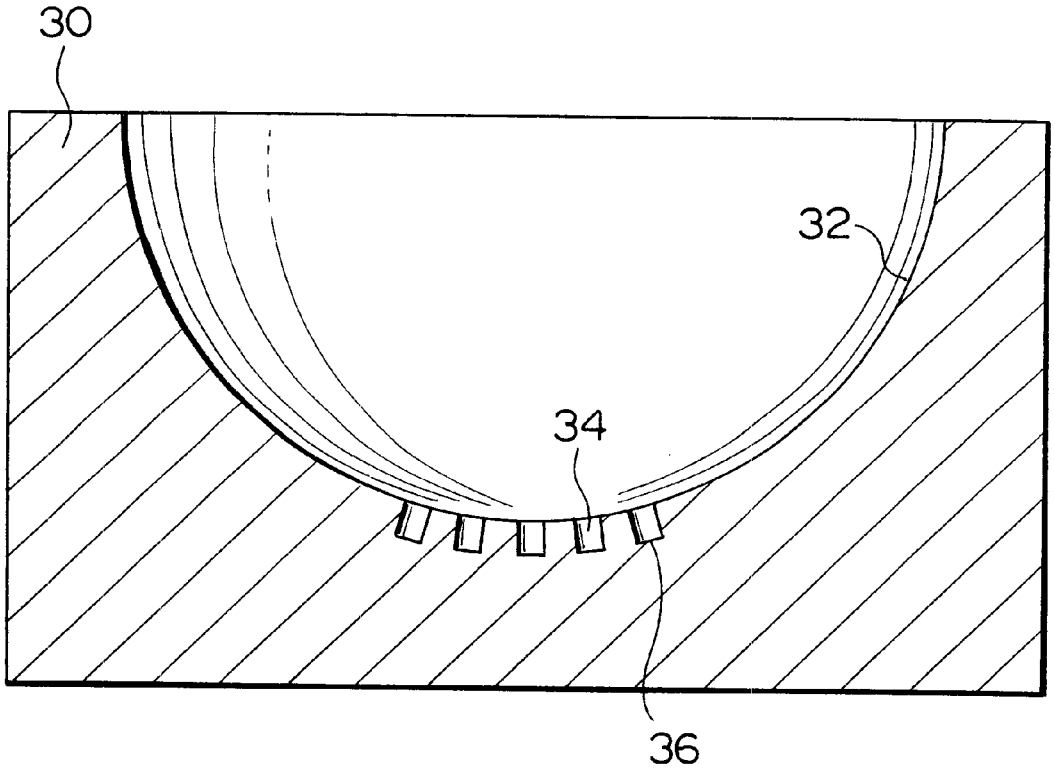
FIG. 4 is a sectional view showing one of the upper and lower halves of an inner-cover mold of the molding machine shown in FIG. 3.

One of upper and lower halves of the inner-cover mold 18 has a shape shown in FIG. 4. One half 30 has a main hemispherical cavity surface 32 which corresponds to the portion of the outer surface of the inner cover on which the protrusions 8 are not formed. The half 30 also has recesses 34 which correspond to the protrusions 8 of the inner cover 4. The recesses 34 each have a bottom surface 36 of a shape corresponding to that of a dimple. In the present embodiment, the other half of the inner-cover mold 18 has a hemispherical cavity having no recesses. However, when another mark portion is formed on the golf ball at a portion corresponding to the other half of the inner-cover mold 18, recesses may be formed in the other half.

The half 30 of the inner-cover mold 18 can be formed by the following Method 1 or 2:

Method 1: A mold half is first prepared such that the mold half has only a main hemispherical cavity surface 32 which corresponds to the outer surface of the inner cover having no protrusions 8. Then, the recesses 34 are formed on the main cavity surface 32 through cutting work. The cutting work may be carried out by use of a known method, such as electrical discharge machining or numerical control (NC) machining.

Figure 5A:
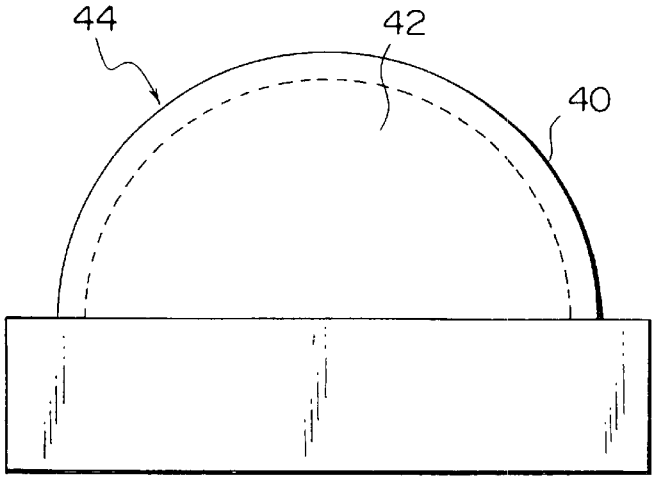
FIGS. 5A and 5B are explanatory views showing a procedure for preparing a master used for production of the mold shown in FIG. 4.
Figure 5B:
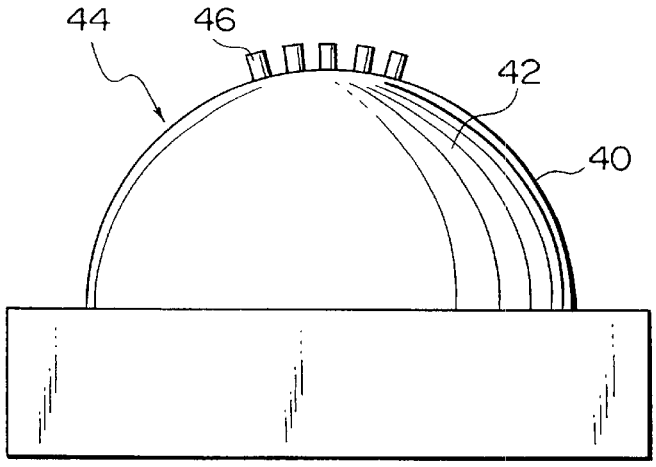

Method 2: A mold half is fabricated by use of a master 44 as shown in FIG. 5A. The master 44 has a hemispherical portion 42 whose outer surface 40 corresponds to the outer surface of the outer cover. The master refers to a male mold which is used for preparation of a mold half (female mold). Depressions for formation of the dimple-forming projections are formed on the outer surface 40. The broken line in FIG. 5A shows the position of the outer surface of the inner cover. As shown in FIG. 5B, the outer surface 40 undergoes cutting work to form protrusions 46 which correspond to the recesses 34 of the mold half 30. The cutting work may be carried out by use of the same method as described above. Subsequently, the half 30 of the inner-cover mold 18 is produced by means of electroforming or casting through use of the thus-obtained master 44.

Each of the upper and lower halves of the auxiliary-layer mold 20 has a hemispherical cavity surface which corresponds to the shape of the auxiliary layer 12, and can be produced in a manner similar to that for the inner-cover mold 18. Each of the upper and lower halves of the outer-cover mold 22 has a hemispherical cavity surface which corresponds to the outer surface of the outer cover 6. A large number of dimple-forming projections are formed on the cavity surface.

The procedure for manufacturing the golf ball of the present embodiment through use of the molding machine shown in FIG. 3 is as follows (see FIGS. 1A and 2):

(1) A core prepared in advance is placed in the cavity of the inner-cover mold 18, and resin is injected from the inner-cover injection cylinder 24 into the cavity of the inner-cover mold 18, whereby the inner cover 4 having the protrusions 8 is formed on the core 2.

(2) The thus-produced intermediate product is removed from the inner-cover mold 18 by use of a tool such as a chucking handle which has been positioned in advance through positioning control, and the intermediate product is placed in the cavity of the auxiliary-layer mold 20. Subsequently, resin is injected from the auxiliary-layer injection cylinder 26 into the cavity of the auxiliary-layer mold 20, whereby the auxiliary layer 12 is formed in the inner cover 4.

(3) The thus-produced intermediate product is removed from the auxiliary-layer mold 20 by use of a tool such as a chucking handle which has been positioned in advance through positioning control, and the intermediate product is placed in the cavity of the outer-cover mold 22. Subsequently, resin is injected from the outer-cover injection cylinder 28 into the cavity of the outer-cover mold 22, whereby the outer cover 6 having dimples is formed on the inner cover 4.

(4) The surface of the thus-produced golf ball is subjected to finishing, such as coating, as needed, whereby production of the golf ball is completed.

In the case of the golf ball shown in FIG. 1C, as in the case of the golf ball shown in FIG. 1A, (1) the inner cover, (2) the auxiliary layer, and (3) the outer cover are formed in this sequence. In the case of the golf ball shown in FIG. 1B, (1) the auxiliary layer, (2) the inner cover, and (3) the outer cover are formed in this sequence.

EXAMPLES

The present invention will be specifically described by way of examples, which should not be construed to limit the present invention. Golf balls of Examples 1 and 2 (having a structure as shown in FIG. 2) were manufactured by use of the molding machine shown in FIG. 3 and in accordance with the above-described procedure. However, in Example 1, the auxiliary layer was formed in the manner shown in FIG. 1B, and in Example 2, the auxiliary layer was formed in the manner shown in FIG. 1C. These golf balls were manufactured by use of the same mold such that each golf ball had a weight of 45.30 g and an outer diameter of 42.70 mm.

Example 1

Diameter of the core: 33.7 mm

Material of the Core: Rubber composition (base rubber: 1,4-cispolybutadiene)

Thickness of the inner cover measured at a portion where no protrusions are formed (indicated by reference character "m" in FIG. 1B): 1.5 mm Material of the inner cover: Ionomer resin (mixture of Himilan 1706 and 1650 (Mitsui-Du Pont Polychemical), weight ratio: 25/75, Shore D hardness: 61)

Color of the inner cover: Blue

Thickness of the auxiliary layer measured at a portion where no protrusions are formed (indicated by reference character "n" in FIG. 1B): 1.5 mm Material of the auxiliary layer: Ionomer resin (mixture of Himilan 1706 and 1650(Mitsui-Du Pont Polychemical), weight ratio: 25/75, Shore D hardness: 61)

Color of the auxiliary layer: Red

Thickness of the outer cover: 1.5 mm

Material of the outer cover: Ionomer resin (mixture of Himilan 1706 and 1605, weight ratio: 50/50, Shore D hardness: 64)

Color of the outer cover: White

Example 2

Diameter of the core: 36.7 mm

Material of the core: Rubber composition (base rubber: 1,4-cispolybutadiene)

Thickness of the inner cover measured at a portion where no protrusions are formed: 1.5 mm Material of the inner cover: Ionomer resin (mixture of Himilan 1706 and 1650 (Mitsui-Du Pont Polychemical), weight ratio: 25/75, Shore D hardness: 61)

Color of the inner cover: Blue

Thickness of the auxiliary layer: 1.5 mm

Material of the auxiliary layer: Ionomer resin (mixture of Himilan 1706 and 1650(Mitsui-Du Pont Polychemical), weight ratio: 25/75, Shore D hardness: 61)

Color of the auxiliary layer: Red

Thickness of the outer cover: 1.5 mm

Material of the outer cover: Ionomer resin (mixture of Himilan 1706 and 1605, weight ratio: 50/50, Shore D hardness: 64)

Color of the outer cover: White

Comparative Example 1

Figure 6:
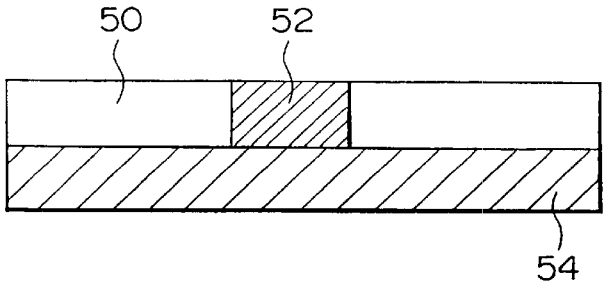
FIG. 6 is a sectional view schematically showing a golf ball of Comparative Example 1.

A golf ball of Comparative Example 1 was produced through compression molding by use of a cover material disclosed in the above-described Japanese Patent No. 2904737. As shown in FIG. 6, the cover material has a hemispherical cup-like shape and is formed by use of two molding materials 50 and 52 of different colors. One molding material 50 forms a cover 50, and the other molding material 52 forms a mark portion (characters and a number as shown in FIG. 2). In FIG. 6, reference numeral 54 denotes a core. As in the case of Examples, the golf ball of Comparative Example 1 was produced such that the golf ball had a weight of 45.30 g and an outer diameter of 42.70 mm. The size and material of each portion are as follows.

Diameter of the core 54: 39.7 mm

Material of the core 54: Rubber composition (base rubber: 1,4-cispolybutadiene)

Thickness of the cover 50: 1.5 mm

Material of the cover 50: Ionomer resin (mixture of Himilan 1706 and 1605, weight ratio: 50/50, Shore D hardness: 64)

Color of the cover 50: White

Material of the mark portion 52: Ionomer resin (mixture of Surlyn 5320 (Du Pont), Himilan 1605, and Himilan 1706, weight ratio: 40/10/50, Shore D hardness: 47)

Color of the mark portion 52: Black

Comparative Example 2

A commercial golf ball in which the mark portion was formed by means of a decalcomania method was used as a Comparative Example 2.

The golf balls of Examples and Comparative Examples were evaluated by the methods below in terms of appearance, durability of the mark portion, and durability of the ball. The results are shown in Table 1.

Appearance:

The finish of each ball was evaluated visually. Ratings were as follows:

◎: Excellent

○: Good

Durability of Mark Portion:

After each golf ball was hit 200 times by use of a hitting machine, the surface state of the mark portion (the portion indicating characters "ALTUS" and number "5") was evaluated visually. The ratings were as follows:

◎: Excellent

○: Good

Δ: Slightly Poor

Durability of Golf Ball:

Each golf ball was repeatedly hit by use of the hitting machine such that the mark portion was hit each time. The number of hits before the golf ball was broken was counted and compared with that of Comparative Example 1 in order to evaluate each golf ball. The evaluation was performed on the basis on the following ratings, in which a golf ball which exhibited durability that was at least 10% greater than that of Comparative Example 1 was evaluated as "Good."

○: Good

X: Poor (Broken in early stage)

TABLE 1

| | Example 1 | Example 2 | Comparative Example 1 | Comparative Example 2 |
|---|---|---|---|---|
| Appearance | ◎ | ◎ | ◎ | ○ |
| Durability of mark portion | ◎ | ◎ | ○ | Δ |
| Durability of golf ball | ○ | ○ | X | ○ |

As shown in Table 1, the golf balls of the present invention exhibit better appearance and higher durability of the mark portion than does the commercial golf ball in which the mark portion is formed by means of the decalcomania method. The golf ball of Comparative Example 1 exhibits poor ball durability, because the molding material for forming the mark portion did not cover the core completely.

As described above, the golf ball of the present invention can be manufactured in a simple process and the mark portion can be formed without any independent forming step therefor. Therefore, manufacturing cost can be reduced. In addition, durability of the mark portion and that of the ball itself as well as appearance of the ball are excellent. In addition, the mark portion is of excellent design.

What is claimed is:

1. A golf ball comprising:

a core;

an inner cover;

an outer cover enclosing the inner cover; and an auxiliary layer disposed in contact with the inner cover and completely enclosing the core, wherein the inner cover has a color different from that of the outer cover and has protrusions portion which penetrates the outer cover and is exposed to the outside on the surface of the golf ball, the exposed top portion of protrusions portion constituting a mark portion on the surface of the golf ball;

the auxiliary layer has a color different from those of the inner and outer covers and has an end surface which is exposed to the outside on the surface of the golf ball within the mark portion.

2. A golf ball according to claim 1, wherein the difference in Shore D hardness between the inner cover and the outer cover is not greater than 15.

3. A method of manufacturing a golf ball according to claim 1, comprising:

providing an injection molding machine in which an inner-cover mold, an outer-cover mold, and an auxiliary-layer mold are arranged on a common mold base; and molding the inner cover, the outer cover, and the auxiliary layer by use of the injection molding machine.

4. A golf ball according to claim 1, wherein the mark portion on the surface of the golf ball is formed during a molding process of the covers.

5. A golf ball according to claim 1, wherein the mark portion displays one or more of a trademark, a number, a symbol, a figure, or a pattern.

* * * * *

UNITED STATES PATENT AND TRADEMARK OFFICE

CERTIFICATE OF CORRECTION

PATENT NO. : 6,575,847 B1 
DATED : September 25, 2000
INVENTOR(S) : Yamagashi et al.

It is certified that error appears in the above-identified patent and that said Letters Patent is hereby corrected as shown below:

Title page,
Item [*] Notice, delete the phrase “by 119 days” and insert -- by 102 days --

Signed and Sealed this

First Day of March, 2005

JON W. DUDAS
*Director of the United States Patent and Trademark Office*